United States Patent [19]

Lucas et al.

[11] 4,022,996

[45] May 10, 1977

[54] SWITCH MECHANISM FOR BUS DOORS WITH MANUALLY OPERATED TOUCH BAR

[75] Inventors: Richard L. Lucas, Owosso; Robert M. Gute, Corunna, both of Mich.

[73] Assignee: Midland-Ross Corporation, Cleveland, Ohio

[22] Filed: Sept. 11, 1975

[21] Appl. No.: 612,444

[52] U.S. Cl. ..... 200/61.43; 49/27

[51] Int. Cl.[2] ..... H01H 3/16; E05F 15/00

[58] Field of Search ..... 200/4, 6, 61.41, 61.42, 200/61.62, 61.71–61.75, 329–332, DIG. 29, 61.43; 49/27

[56] References Cited

UNITED STATES PATENTS

| | | | |
|---|---|---|---|
| 2,523,645 | 9/1950 | Bruestle | 200/61.43 |
| 2,687,455 | 8/1954 | Norman | 200/61.43 |
| 3,330,923 | 7/1967 | Brockmeyer et al. | 200/61.43 |
| 3,537,211 | 11/1970 | Guilbert, Jr. et al. | 200/61.43 |

*Primary Examiner*—James R. Scott
*Attorney, Agent, or Firm*—Woodrow W. Portz

[57] ABSTRACT

Disclosed is an apparatus for use in opening bus doors and the like comprising a touch bar supported by having its ends received in a pair of housings within one or both of which is mounted a reciprocal electrical switch mechanism responsive to lateral movement of the touch bar in any direction relative to a housing containing the switch mechanism. Switch actuation is obtained by providing opposed concave surfaces in fixed association with the touch bar and associated housing with the surfaces operated by a round element, such as a ball. Any rolling of the ball from centered position causes parting movement of the elements defining opposed concave surfaces and linear movement of one of the elements useful for switch actuation.

9 Claims, 1 Drawing Figure

SWITCH MECHANISM FOR BUS DOORS WITH MANUALLY OPERATED TOUCH BAR

BACKGROUND OF THE INVENTION

In the operation of public transit services, it is desired to provide one man operated buses or rail cars with passenger-operable door-opening controls at doors of a vehicle remote from the vehicle operator's post. In known arrangements, the vehicle operator has within convenient reach a multi-position electro-pneumatic or electrical controller which enables him to place the electro-pneumatic door operating system of the vehicle in condition for enabling a passenger to open the door through bodily contact or by contact of articles carried by him with switching mechanism preferably mounted on the door. Such doors are commonly constructed in sections which part at the middle with the door-opening switching mechanism mounted along vertical meeting edges of the door sections. In the form herein contemplated, any such door-opening mechanism includes a vertical extending touch bar of which slight movement relative to the door actuates a switch for actvating a door-opening circuit. Normally, the electro-pneumatic door opening system is arranged to operate on a cycle including door-shutting after a small time interval but to start a new cycle whenever the door-opening switching mechanism is engaged provided the controller handle is in the "door-open" position or the door has not returned to a completely closed position.

Objects of the invention are to: provide simple trouble-free touch-bar switching mechanism for activating electro-pneumatically operated door mechanisms of any type door; to provide such mechanism especially adaptable for mounting on mass transit vehicle doors; to provide the mechanism in a form that is responsive to exterior force applications from any direction including upward or downward; and to provide mechanism of the foregoing objects in accordance with simple design which can be manufactured at relatively low cost within this product field.

SUMMARY OF THE INVENTION

The invention is embodied in manually operable switch apparatus comprising a touch bar and first and second spaced assemblies which receive end portions of the end bar and are adapted for attachment to any convenient support such as a section of a door. Each assembly comprises a housing for receiving an end portion of a touch bar with freedom for small range of lateral movement in any direction. Either or both housings may contain a switch which provides a plunger protruding toward the adjacent end portion of the touch bar. Between the touch bar and any such switch are elements defining opposed conically concave surfaces separated by a round element such as a sphere, which in operation "climbs" the slopes of the two opposing conical surfaces to shift the switch plunger and the conical surface element in contact therewith. Resilient means is provided to force the movable portions of the assembly back into neutral centered positions when the bar is no longer urged out of neutral position.

BRIEF DESCRIPTION OF THE DRAWING

In the accompanying drawing.

DESCRIPTION OF THE PREFERRED EMBODIMENTS

Figure 1:
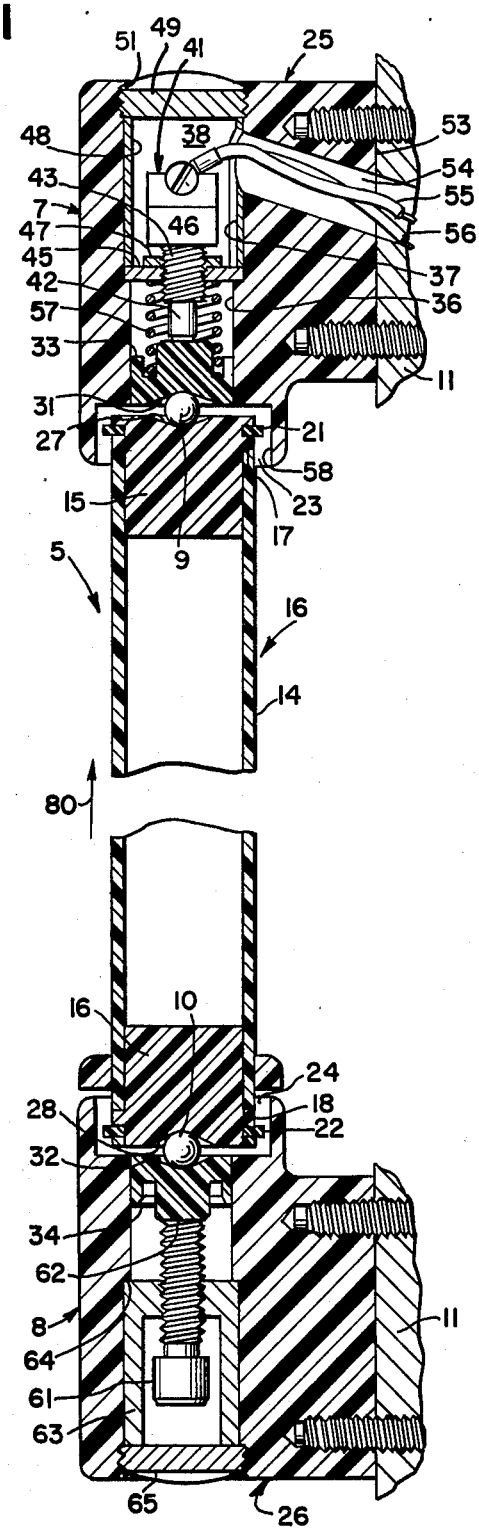
FIG. 1 is a vertical shortened cross section of the apparatus of the invention taken along the longitudinal axis of the touch bar.

FIG. 1 illustrates a touch bar switch apparatus 5 according to the invention comprising a touch bar 6, an upper assembly 7 which receives the upper end portion of the bar 6, and a lower assembly 8 which receives the lower end portion of the bar 6, and balls 9, 10 which separate the ends of the touch bar from respective adjacent assemblies. 7, 8. As indicated hereinbefore, the assemblies, or more particularly, the housings thereof, are fixed to a common base, such as a vehicle door.

The bar 6 comprises a tube 14 of a suitably rigid material, and plugs 15, 16 extending into, and secured in, opposite ends of the tube 14. The plugs as shown, are of swedged outer surface, i.e., of the two diameters providing shoulders 17, 18 helpful in locating the plugs in proper position relative to the length of the tube. The portions of the plugs extending beyond the tube are shown with annular grooves in which resilient washers 21, 22 are received. These washers function as resilient buffers in restricting lateral movement of respective ends of the touch bar within the adjacent recesses 23, 24 of the housing 25, 26 of assemblies 7, 8 respectively. Plugs 15, 16 have concave, generally conical surfaces 27, 28 centered with respect to the longitudinal axis of the touch bar 6 in which balls 9, 10 are centered at neutral condition of the apparatus 5. While many elements of the entire switch apparatus are shown as constructed on non-metallic material, metal substitutions may be readily made in most instances. Surfaces 27, 28 are opposed by similarly shaped surfaces 31, 32, respectively, of pistons 33, 34, respectively. Preferably surfaces 27, 28, 31, 32 are of similar right concial configuration with the slant heights thereof extending at an angle, such as 20 degrees with the diametric plane of the elements on which these surfaces occur. Geometry of this order causes the opposite sides of either ball 9 or 10 to roll along sides of opposed concial surfaces essentially in parallelism in a manner which produces linear displacement of the piston 33.

In the assembly 7, the housing has a main rectilinear passageway therethrough which may comprise, as shown, cylindrical sections of different diameters. An intermediate smallest diameter section is defined by a cylindrical surface 36 forming a complementary cylinder for the piston 33. A larger diameter section 37 defines a cavity 38 of suitable length and diameter for housing a switch 41 having a pressure of thrust sensitive portion, such as a plunger 42 reciprocable within an exteriorly threaded sleeve 43 which is resiliently retractable to effect actuation of the switch. The switch 41 is supported within the cavity 38 by threaded relation of the sleeve 43 with a threaded element 45 such as a washer seated along its outer perimeter on a shoulder 46 occurring at the change of diameter of cylindrical sections 36, 37. A lock nut 47 in threaded relationship with the sleeve 43 and tightened against the washer 45 prevents the switch from rotating. The switch is otherwise secured within the cavity by a sleeve 48 fitting the exterior surface of the cavity 38 and held tightly against the washer 45 by a plug 49 having its perimeter in threaded relation with an interiorly threaded surface 51 of the entrance portion of the main passageway of the housing. The housing is formed with a boss portion 53 which provides an aperture 54 intersecting with the cavity 38. The sleeve 48 is cut away along this intersection to receive wires 55, 56 connected with the switch 41.

While the switch 41 may comprise an internal spring for maintaining the plunger in outwardly extending relation with the sleeve 43, the washer 45 and the piston 33 provide opposed seats for receiving a spring 57, normally under compression, which maintains the piston in contact with the ball 9.

The recess 23 partially defined by the largest cylindrical surface 58 of the longitudinal passageway of the housing is of sufficient diameter to allow such lateral freedom of movement of the bar 6 as to cause movement of the piston 33 through an eighth of an inch or other short distance needed to depress the plunger for operation of the switch 41.

As shown, the housing 26 of the assembly 8 is identical with housing 25 of assembly 7. As one option, the housing 26 may be equipped with internal hardware similar to that of assembly 7. Such an option will provide another switch similar to switch 41 and somewhat more sensitive control of doors. Where such sensitivity is not needed, support for the ball 10 within the housing may be rigid rather than resilient as found in assembly 7. As shown, the housing 26 contains a piston 34 identical with piston 33 already described. The piston is held to a fixed elevation within the housing by a set screw 61 which engages the piston on the surface 62 thereof normally engaged by a switch plunger. The set screw 61 is supported within the housing 26 by threaded relation with a socket 63 secured against the housing shoulder 64 by a plug 65 in threaded relation with the entrance portion of the main passageway through the housing.

In operation with reference to FIG. 1, a light application of manual force to the touch bar 6 will cause it to roll one of the balls 9, 10 along respective adjacent concave surfaces of the touch bar or a housing. When the ball 10 is so rolled, the touch bar moves in the direction of the arrow 80 to cause movement in the same direction as the piston 33 and depression of the plunger 42 inwardly of the switch 41. Force applied to the touch bar close to the assembly 7 causes rolling movement of the ball 9 and operation of the switch without endwise movement of the touch bar. The resulting actuation of the switch is utilized to operate door opening mechanism not shown. The embodiment shown in FIG. 1 is also operable under any manual effort applied to the touch bar in the direction of the arrow 80. When the housing 26 is equipped with the same hardware as housing 25 and operates as a switching assembly as hereinabove described, then the total switching apparatus responds not only to lateral and upward movements of the touch bar but to downward movements as well. Thus, movement of the touch bar in any conceivable direction can result in a door opening operation.

What is claimed is:

1. Manually operable switch apparatus comprising a touch bar and first and second spaced assemblies to which opposite end portions of the bar are attached, each assembly having a housing normally fixed to a common base, said bar having fixed to one end portion an end plug; said first assembly comprising:

one of said housings providing a recess for receiving said end plug defined partially by an interior circular side wall surface having a radial clearance with said end plug and any associated portion of the bar extending thereinto, said housing defining a bore extending in coaxial relation with the recess further inwardly of the housing;

a switch fixed to said housing having a plunger protruding coaxially into said bore;

a piston received in said bore normally positioned against said plunger, said piston and said end plug having opposing concave surfaces;

an element providing a circular surface received between, and normally in engagement with, both of said concave surfaces;

resilient means located between said switch and said piston for urging said bar, said element, said piston, and switch to neutral centered positions placing said switch in an unactuated condition;

said second assembly having its housing normally attached to said base to locate the second assembly in fixed axially spaced relation with said first assembly so as to engage and act on the bar in its longitudinal direction to maintain series contact between said end plug, said element, said piston, and said plunger; and said bar and end plug being laterally movable relative to said housing to roll said element on said concave surfaces and thus move said piston and plunger to effect actuation of the switch.

2. The apparatus of claim 1 wherein:

said element is spherical.

3. The apparatus of claim 2 comprising:

a second plug fixed to the opposite end portion of said touch bar;

said second assembly having a recess for receiving said second plug of which its inward end surface is concave and in opposition with a similar concave surface of said second plug; and a second spherical element between said concave surfaces.

4. The apparatus of claim 3 wherein:

said second assembly comprises an abutment block defining said inward concave surface thereof and means for adjusting said block to fixed positions in the lengthwise direction of the touch bar.

5. The apparatus of claim 1 wherein:

an annular surface on the end of said piston opposite that engaging said element defines a first spring seat;

the apparatus comprises annular spring seat means fixed in said housing in spaced concentric facing relation with said spring seat; and a spring positioned between said spring seat and said spring seat means in a state of compression.

6. The apparatus of claim 1 comprising:

resilient ring means disposed between said recess surface and the assembly of said touch bar and end plug for urging said end plug into a concentric relation with said recess means.

7. The apparatus of claim 1 wherein:

said housing defines a cavity continuous with said bore extending in a direction away from said recess for housing said switch.

8. The apparatus of claim 7 comprising:

shoulder means located at the junction of said bore and said cavity and facing away from the bore;

support means connected with the switch; and retainer means in said cavity engaging the housing and the supporting means to secure the latter against said shoulder means.

9. Manually operable switch apparatus comprising a touch bar and first and second spaced assemblies to which opposite end portions of the bar are attached, each assembly having a housing normally fixed to a common base, said bar being closed at one end to provide an end portion defining a concave end surface; said first assembly comprising:

one of said housings providing a recess for receiving said end portion defined partially by an interior circular side wall surface having a radial clearance with said end portion, said housing defining a bore extending in coaxial relation with the recess further inwardly of the housing;

a piston received in said bore having a concave surface in opposed relation with said concave surface of said bar;

a switch fixed to said housing having a pressure-sensitive portion by which it is operable in facing engagement with said piston within said bore;

an element providing a circular surface received between, and normally in engagement with, both of said concave surfaces;

resilient means located between said switch and said piston urging said bar, said element, said piston, and switch to positions placing said switch in an unactuated condition;

said second assembly having its housing normally attached to said base to locate the second assembly in fixed axially spaced relation with said first assembly so as to engage and act on the bar in its longitudinal direction to maintain series contact between said end portion, said element, said piston, and said pressure sensitive portion; and said bar being laterally movable relative to said housing to roll said element on said concave surfaces to effect acutuation of the switch.

* * * * *

UNITED STATES PATENT OFFICE

CERTIFICATE OF CORRECTION

Patent No. 4,022,996 Dated May 10, 1977

Inventor(s) Richard L. Lucas et al. Page 1 of 2

It is certified that error appears in the above-identified patent and that said Letters Patent are hereby corrected as shown below:

The drawing on the Title Page should read as follows:

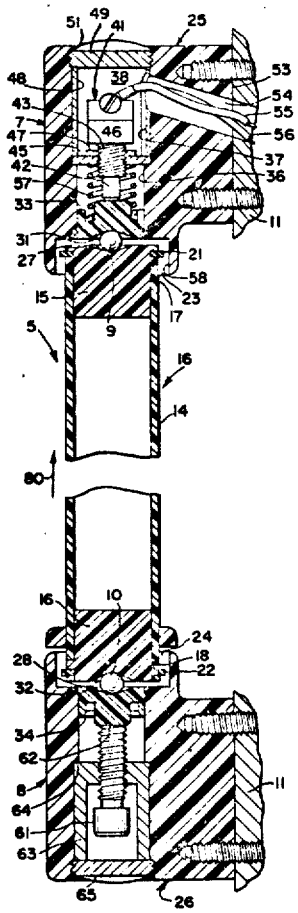

UNITED STATES PATENT OFFICE

CERTIFICATE OF CORRECTION

Patent No. 4,022,996 Dated May 10, 1977

Inventor(s) Richard L. Lucas et al.

It is certified that error appears in the above-identified patent and that said Letters Patent are hereby corrected as shown below:

In the abstract, line 10, "operated" should be --separate--.

Col. 1, line 34, insert --of-- after "type",

Col. 2, line 10, delete the period after assemblies; line 17, delete "the"; line 31, change to --of--; line 40, should be --conical--; line 50, "of" should be --or--; line 58, "relationship" should be --relation--.

In the claims, claim 7, line 57, "continuous" should be --contiguous--.

Signed and Sealed this thirtieth Day of August 1977

[SEAL]

Attest:

RUTH C. MASON
Attesting Officer

C. MARSHALL DANN
Commissioner of Patents and Trademarks